US010308263B1

(12) United States Patent
Ring et al.

(10) Patent No.: US 10,308,263 B1
(45) Date of Patent: Jun. 4, 2019

(54) CUSHIONING APPARATUS FOR A RAILWAY CAR

(71) Applicant: Strato, Inc., Piscataway, NJ (US)

(72) Inventors: Michael Ring, Lake Village, IN (US); Jonathan Sunde, Somerset, NJ (US)

(73) Assignee: STRATO, INC., Piscataway, NJ (US)

( * ) Notice: Subject to any disclaimer, the term of this patent is extended or adjusted under 35 U.S.C. 154(b) by 29 days.

(21) Appl. No.: 15/814,853

(22) Filed: Nov. 16, 2017

(51) Int. Cl.
*B61G 9/06* (2006.01)
*B61G 9/10* (2006.01)
*B61G 9/22* (2006.01)

(52) U.S. Cl.
CPC ..... *B61G 9/10* (2013.01); *B61G 9/22* (2013.01); *B61G 9/06* (2013.01)

(58) Field of Classification Search
CPC ... B61G 9/00; B61G 9/04; B61G 9/06; B61G 9/10; B61G 9/12; B61G 9/20; B61G 9/22; B61G 9/24; B61G 11/00; B61G 11/14
See application file for complete search history.

(56) References Cited

U.S. PATENT DOCUMENTS 2,469,126 A * 5/1949 Munro ..... B61G 9/06 213/46 A
2,559,743 A * 7/1951 Williams ..... B42D 5/008 213/44
2,728,465 A 12/1955 Campbell
2,766,894 A 10/1956 Campbell
2,825,472 A 3/1958 Peterson
3,197,037 A * 7/1965 Willison ..... B61G 7/10 213/21
3,370,718 A 2/1968 Waddell
3,800,961 A * 4/1974 Hawthorne ..... B61G 9/04 213/43
3,838,778 A * 10/1974 Appleton ..... B61G 9/06 213/40 R
5,487,480 A * 1/1996 Page ..... B61G 9/08 188/287
6,446,820 B1 9/2002 Barker et al.
8,590,717 B2 * 11/2013 Wilt ..... B61G 9/06 213/22
8,870,002 B2 * 10/2014 Wilt ..... B61G 9/14 213/22
8,939,300 B2 * 1/2015 Wilt ..... B61G 9/06 213/22
8,985,355 B2 * 3/2015 Wilt ..... B61G 9/06 213/45
9,056,618 B2 * 6/2015 Gagliardino ..... B22D 25/02
D781,179 S * 3/2017 Schoedl ..... D12/42
9,598,092 B2 * 3/2017 James ..... B61G 7/10
9,669,848 B2 * 6/2017 Creighton ..... B61G 9/10
9,789,888 B2 10/2017 Wilt et al.
(Continued)

OTHER PUBLICATIONS

International Search Report for corresponding PCT Appl. No. PCT/US2018/061286 dated Jan. 25, 2019.

*Primary Examiner* — Jason C Smith
(74) *Attorney, Agent, or Firm* — Pearl Cohen Zedek Latzer Baratz LLP

(57) ABSTRACT

An improved selective travel cushioning device for a railway car is responsive to both draft and buff loads on the coupler, fitting into a standard cushioning unit pocket with little or no reconfiguration of the sill required, while limiting wear on elastic members in the cushioning unit and exhibiting high energy absorption.

13 Claims, 6 Drawing Sheets

(56) References Cited

U.S. PATENT DOCUMENTS

| | | | | |
|---|---|---|---|---|
| 9,868,453 | B2 | 1/2018 | Johnson et al. | |
| 1,001,128 | A1 | 7/2018 | Gagliardino et al. | |
| 1,008,685 | A1 | 10/2018 | Iler | |
| 10,086,852 | B2 | 10/2018 | Iler | |
| 2008/0008225 | A1* | 1/2008 | Ahmad | G01W 1/17<br>374/109 |
| 2008/0011700 | A1* | 1/2008 | Brough | B61G 9/24<br>213/75 R |
| 2017/0080956 | A1 | 3/2017 | James et al. | |
| 2017/0166225 | A1* | 6/2017 | Schoedl | B61G 9/04 |
| 2017/0210398 | A1* | 7/2017 | Wilt | B61G 9/10 |
| 2018/0118235 | A1 | 5/2018 | Johnson et al. | |

* cited by examiner

CUSHIONING APPARATUS FOR A RAILWAY CAR

BACKGROUND OF THE INVENTION

The invention is directed to a cushioning apparatus for a railway car, and more particularly to a selective travel apparatus that absorbs draft and buff loads applied to a coupler of a railway car.

As is generally known, railway cars are connected to an adjacent car by a coupler. The coupler is joined to a yoke, for example an "E-type" or "F-type" yoke, by a draft key or pin, and the assembly is mounted in a railway car center sill.

To prevent damage to the railway cars and the laded goods during operation, and especially during assembly of the railway car train in the yard, various devices have been installed to absorb loads on the coupler so that impact forces are not transmitted to the railway car.

In a conventional frictional draft gear, one or more elastic elements, such as a coil spring or a set of elastomeric pads, is enclosed in a housing mounted in the yoke behind the coupler. A piston-like element frictionally received in the housing absorbs buff loads transmitted via a coupler follower which moves inside the yoke in response to buff impact force applied on the coupler, and the draft gear is compressed in the yoke in response to draft loads. The basic draft gear apparatus has been used for decades. However, in many cases unacceptably large forces are transmitted to the railway car.

A hydraulic cushioning unit comprises a piston received in a cylinder filled with fluid. Such devices may dissipate more force than a conventional draft gear, but they are known to be prone to leakage.

U.S. Pat. No. 2,766,894 describes a selective travel draft gear with separate cushioning elements for buff and draft loads on the coupler. In this design, both of the cushioning elements are located forward of the back wall of the yoke.

U.S. Pat. No. 2,825,472 describes a selective travel draft gear which comprises separate cushioning elements for buff and draft loads on the coupler, but both stacks of cushioning elements are attached to the yoke.

U.S. Pat. No. 6,446,820 discloses a selective travel draft gear of more recent vintage where the separate draft and buff cushioning elements are coupled and adapted to fit into the draft gear pocket. These apparatuses have not been very well received, and may be prone to buckling, wherein a stack of elastomeric elements is pushed out of alignment and fails to operate according to specifications.

All of the above-referenced U.S. Patents are incorporated by reference.

SUMMARY OF THE INVENTION

In view of the prior art, one object of the invention is to provide an alternative cushioning device that provides cushioning over a range of impact speeds.

Another object of the invention is to provide a cushioning apparatus for a railway car that provides cushioning for both draft and buff loads applied to the coupler, limiting force transmitted to the railway car over a range of impact speeds, such as may be encountered during train build, where impact speeds may be in the neighborhood of 4-14 mph or higher, and during start-up and stopping. Embodiments according to the invention may exhibit low displacement per unit of force applied over a range of relevant force levels.

Yet another object of the invention is to provide improved alignment and positioning of elastomeric pads in a cushioning device, to prevent over-compression, permanent deformation, and buckling during use.

Yet another object of the invention is to provide a cushioning apparatus that absorbs both draft and buff loads in a compact format, more easily installed in a standard pocket such as for an AAR standard EOC-9 or EOC-10 configuration.

These and other objects of the invention are met in one aspect with an end-of-car cushioning device for a railway car, comprising: a yoke having aligned apertures at a front end adapted to receive a pin or key for attaching the yoke to a railway car coupler, and having a vertical wall at a second end of the yoke opposite the front end; a coupler-receiving member adapted to receive buff force from the coupler and adapted to move inside the yoke; a first stack of elastomeric units positioned between the coupler-receiving member and the vertical wall of the yoke, said first stack being compressed by draft and buff loads on the coupler; a front buff plate positioned adjacent to and rearward of the yoke and connected to a rear buff plate by a center rod; a second stack of elastomeric units positioned between the front buff plate and the rear buff plate, said second stack being compressed in response to buff loads on the coupler; wherein, the yoke, the front buff plate and the rear buff plate are positioned within a center sill of the railway car; and wherein, the yoke is not mechanically attached to the front buff plate or the rear buff plate.

In another aspect, the invention resides in the arrangement of the plurality of elastomeric units, each comprising a plate and an elastomeric pad positioned in the middle of the plate. A first set of the plates is arranged in a rear or "buff" stack and the plates are each sized to fill the sill area to ensure alignment of the elastomeric pads. A second set of plates is arranged in a front or "draft" stack, sized to fit inside a yoke. The edges of the plates extending around the elastomeric pads are configured so that the plates can nest with each other, and at full compression the edges of the plates contact one another to prevent overcompression of the individual elastomeric pads.

BRIEF DESCRIPTION OF THE FIGURES

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

The drawings are not to scale, and features not necessary for an understanding of the invention are not shown.

DETAILED DESCRIPTION OF THE INVENTION

Directions and orientations herein refer to the normal orientation of a railway car in use. Thus, unless the context clearly requires otherwise, the "front" of a coupler is in a direction away from the body of the car and "rear" is in a direction toward the center of the car. Likewise, the "longitudinal" axis or direction is parallel to the rails and in the direction of movement of the railway car on the track in either direction. The "transverse" or "lateral" axis or direction is in a horizontal plane perpendicular to the longitudinal axis and the rail. The term "inboard" means toward the center of the car, and may mean inboard in a longitudinal direction, a lateral direction, or both. Similarly, "outboard" means away from the center of the car. "Vertical" is the up-and-down direction, and "horizontal" is a plane parallel to the rails including the transverse and longitudinal axes.

"Elastomer" and "elastomeric" refer to polymeric materials having elastic properties so that they exert a restoring force when compressed. Examples of such materials include, without limitation, thermoplastic elastomer (TPE), natural and synthetic rubbers such as: neoprene, isoprene, butadiene, styrene-butadiene rubber (SBR), polyurethanes, and derivatives.

As used herein, the term "about" associated with a numerical value is understood to encompass a margin of +/−10% of the value. An object is said to "substantially fill" a space (such as a railway car sill) when just enough space is provided to allow the object to move in the space without interference. This may mean a clearance of up to about inch laterally and up to about % inch vertically.

In embodiments, a cushioning device according to the invention is adapted to fit into an Association of American Railroads ("AAR") standard pocket. The dimensions of a standard pocket and permitted tolerances may be set by the AAR from time to time, and reference herein to AAR standards refers to standards in the AAR Manual of Standards and Recommended Practices in effect at the filing date of this application, including performance standards, such as M-921-B, for hydraulic cushioning units. A person having ordinary skill in the art has a general knowledge of AAR standards and the published AAR standards cited herein are incorporated by reference as background.

Figure 1:
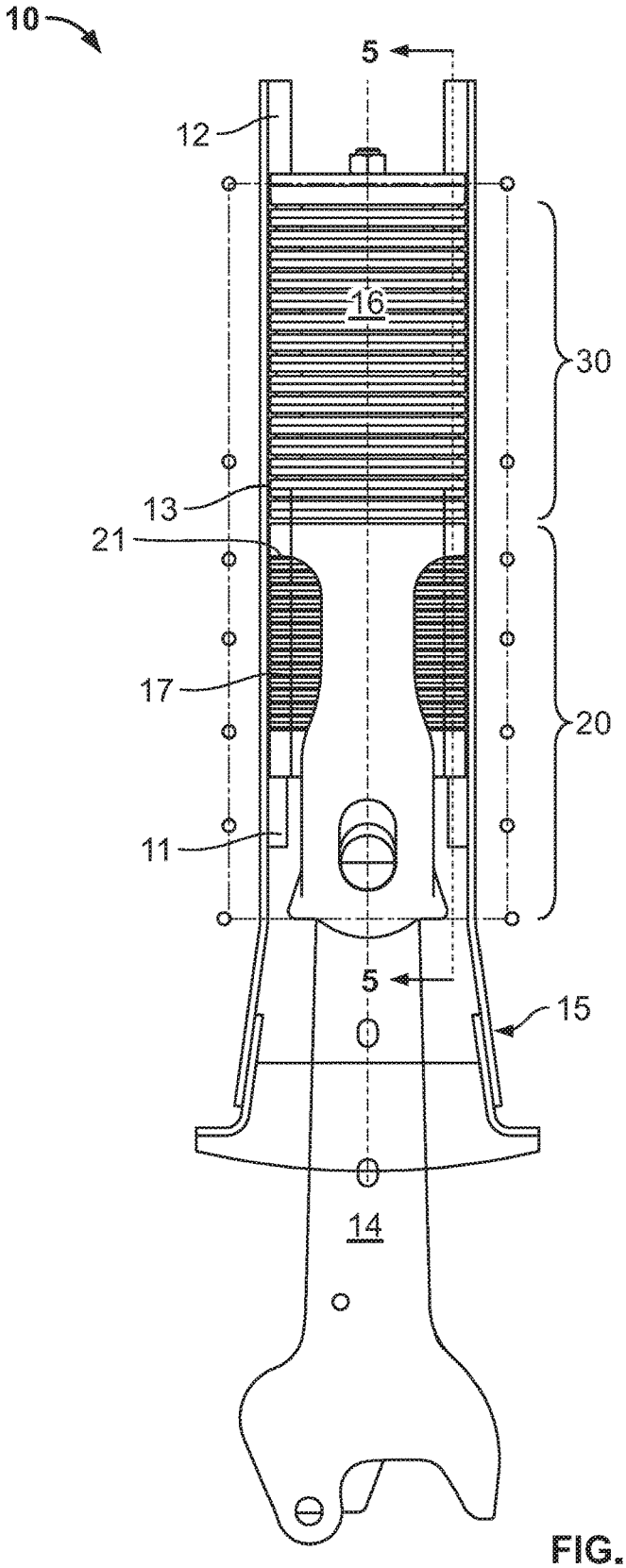
FIG. 1 is top view of a cushioning device assembly according to the invention assembled in a railway car sill.

FIG. 1 depicts a cushioning assembly 10 according to one embodiment of the invention, including a sill 13, coupler 14, and front and rear units 20, 30 of the cushioning device installed in the cushion unit pocket. FIG. 1 depicts center sill 13 with bell shaped opening 15 adapted to accommodate long shank coupler 14 for a greater range of coupler mobility, although the invention is not limited to a long shank coupler configuration.

In embodiments, cushioning device assembly 10 may be characterized by a pocket length of about 38¾ inches described in AAR standard S-183 for an "EOC-9" pocket, or a pocket length of about 48¾ inches described in AAR standard S-184 for an "EOC-10" pocket. In other embodiments, the cushioning device may be adapted to fit other pocket dimensions.

In FIG. 1, and as used herein, the "cushioning unit pocket", or simply the "pocket", is defined by front lugs 11 and rear draft lugs 12 mounted on the interior of center sill 13. According to embodiments of the invention, the cushioning elements are adapted to be inside the center sill without significantly reconfiguring the sill geometry.

Figure 3:
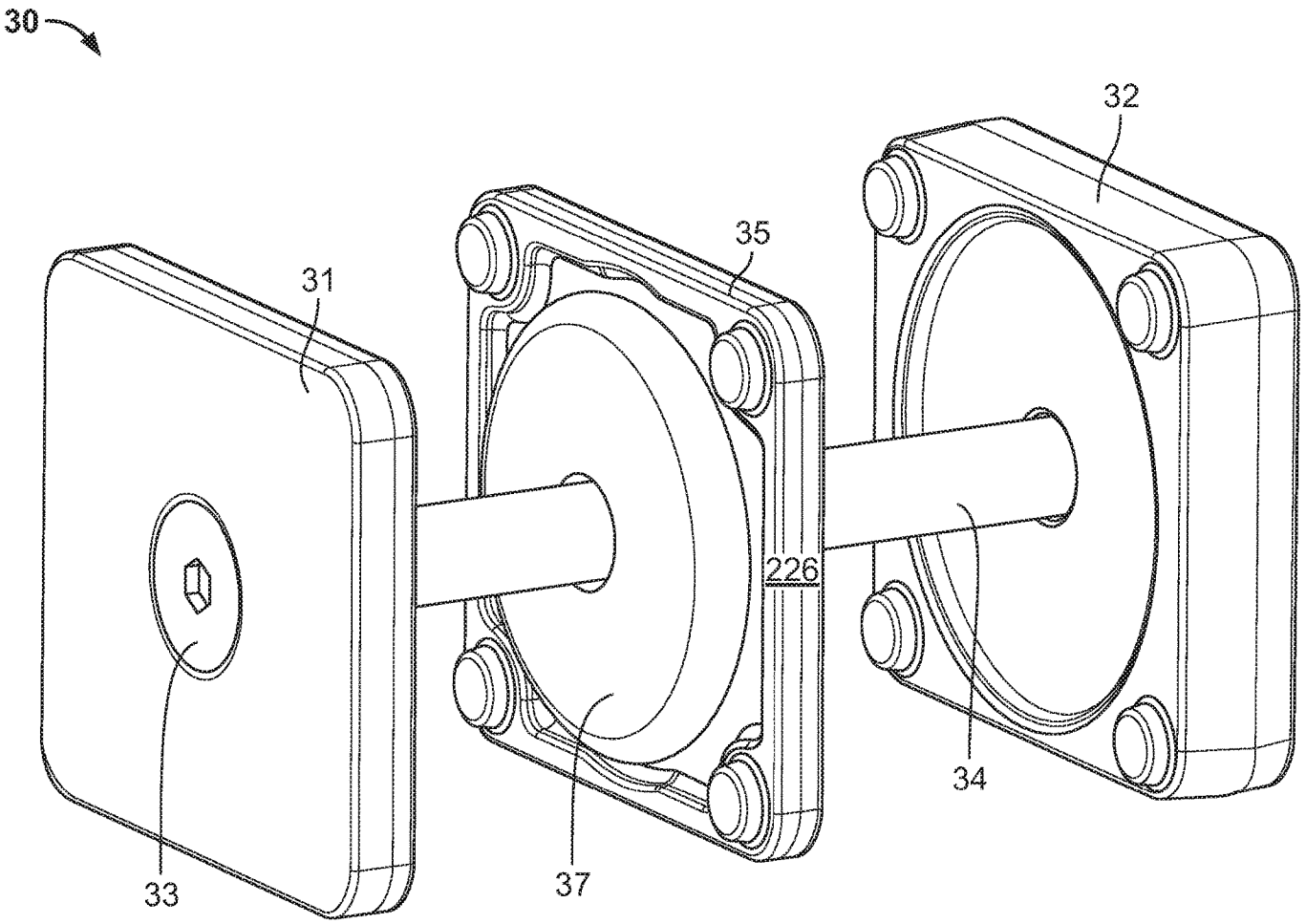
FIG. 3 is an isometric view of a rear portion of a cushioning device according to the invention.

In FIG. 1, the cushioning apparatus comprises a first stack 17 of elastomeric units positioned forward of vertical wall 21 of the yoke, and a second stack 16 of elastomeric units positioned behind the first stack 17, between a front buff plate and the rear buff plate (as shown in FIG. 3). The cushioning unit comprises a front portion 20 and a rear portion 30, which are not fixed to one another.

Figure 2:
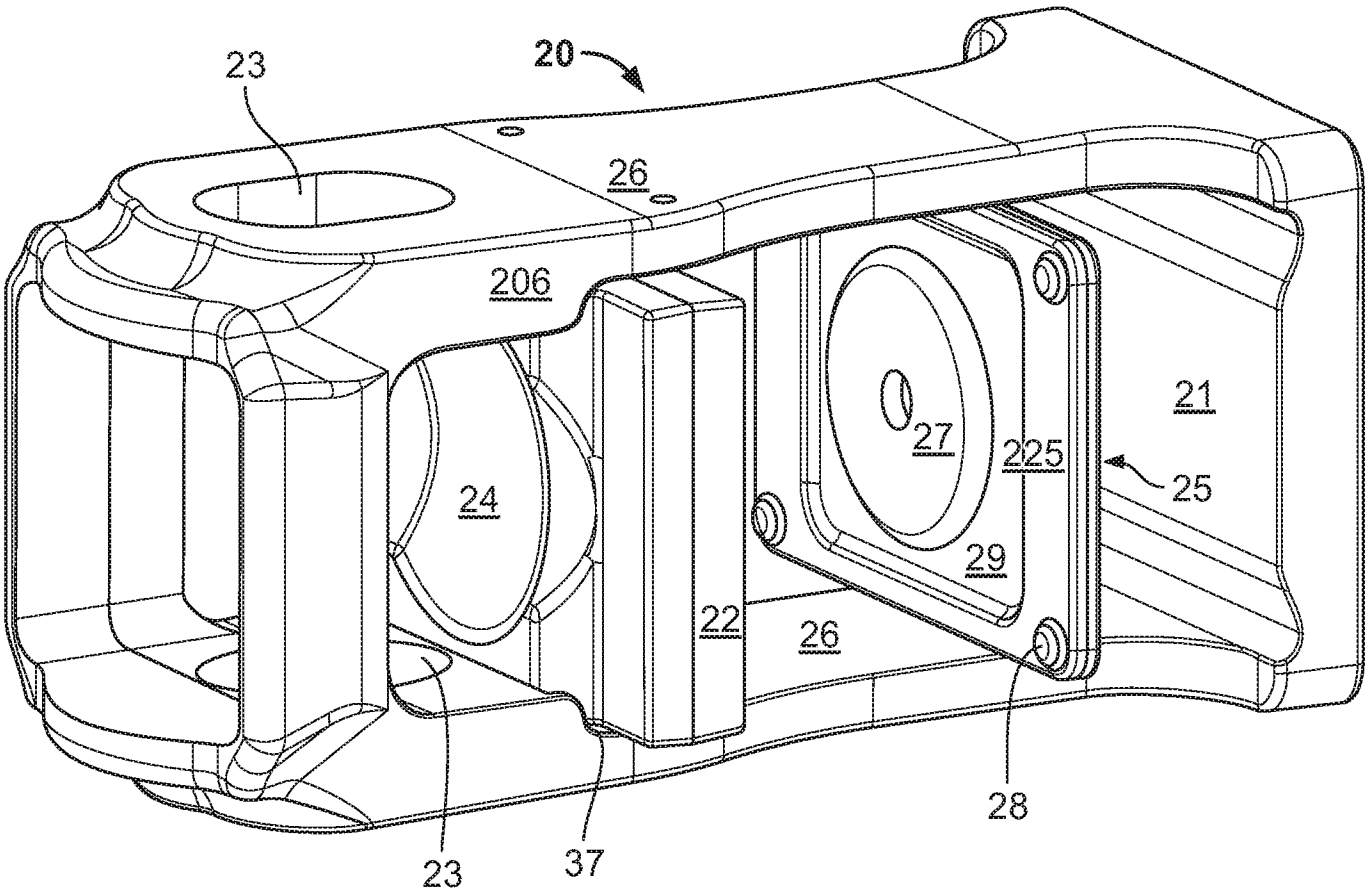
FIG. 2 is an isometric view of a front portion of a cushioning device according to the invention.

FIG. 2 is a view of a front "draft" portion 20 of a cushioning apparatus according to an embodiment of the invention. Yoke 206 includes rear vertical wall 21 and a front portion including two aligned apertures 23 adapted to receive a pin 42 (not shown in FIG. 2). A coupler-receiving member 22, conventionally termed a "coupler follower" is adapted to receive buff force from the coupler and adapted to move inside the yoke. In the embodiment shown, coupler follower 22 includes a recess 24 adapted to receive the shank end of the railway car coupler 14, such that follower 22 moves under buff force from the coupler. The configuration shown in FIG. 2 is "F-type", in that a pin is used to attach coupler 14 (shown in FIG. 4) to yoke 206, and walls 26 are on the top and bottom of the yoke. An "E-type" configuration, using a draft key to attach the coupler to the yoke using draft key, may also be used without departing from the scope of the invention, and indeed without changing the dimensions of elastomeric units 25, or of the stacks 16, 17.

Figure 4:
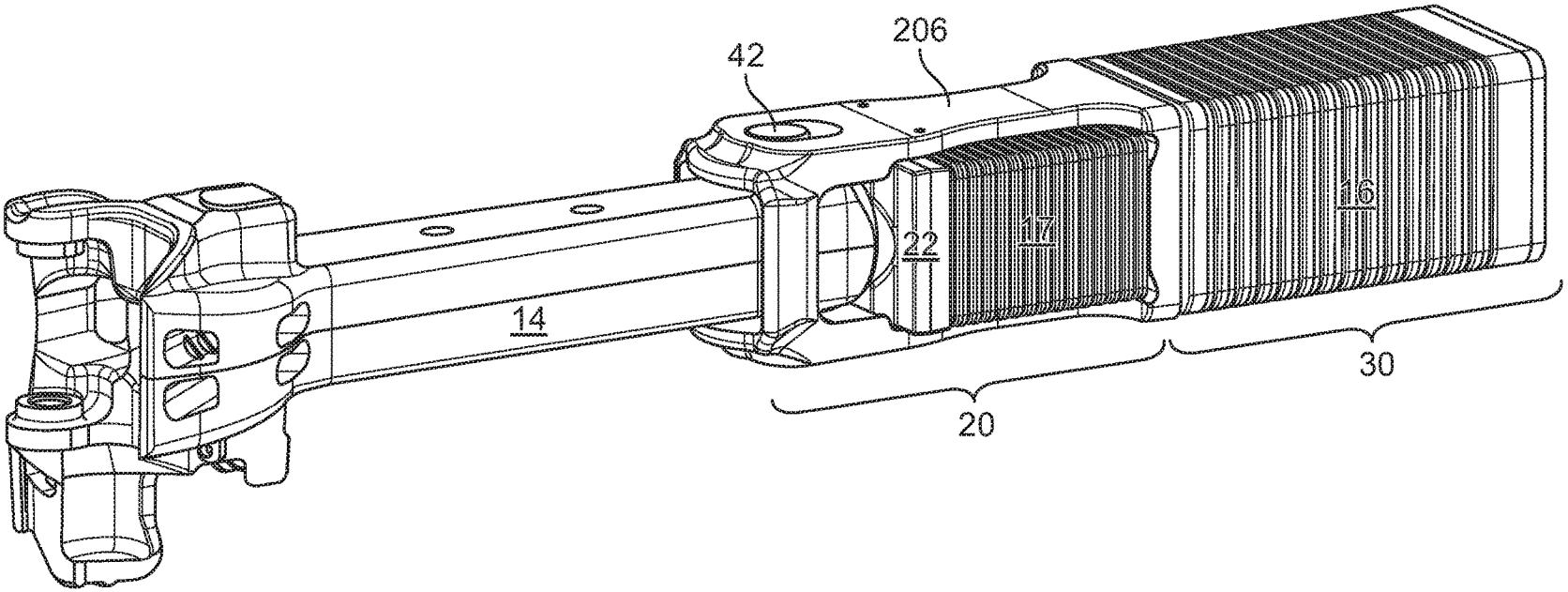
FIG. 4 is an isometric view of an improved selective travel cushioning device according to the invention attached to an "F" Type coupler.
Figure 5:
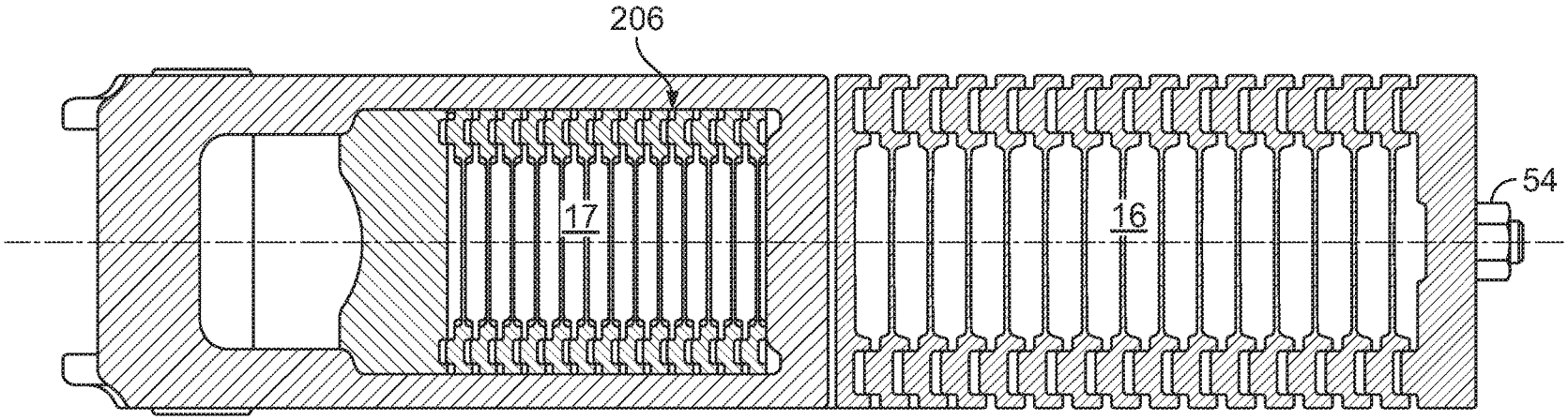
FIG. 5 is a cross sectional view of the improved selective travel cushioning device assembly of FIG. 1, taken along view lines 5-5 of FIG. 1.

For ease of understanding the invention, a single elastomeric unit 25 is shown in FIG. 2 in the space between vertical wall 21 and coupler follower 22, each elastomeric unit comprising a metal plate 225, and at least one elastomeric pad 27. In actual usage, several elastomeric units 25 form stack 17 contained in this space (as shown in FIG. 4 and FIG. 5), which (in one non-limiting example) may be about 9-10 inches from the vertical wall to the follower, in a compressed state, comprising for example, 10-15 plates and a corresponding number of elastomeric pads, although other pad sizes and configurations may be employed to tune performance to a particular type of car or lading. In the embodiment shown, the elastomeric unit 25 includes metal plate 225 and a single elastomeric pad 27. In other embodiments, multiple elastomeric pads may be positioned on a plate. FIG. 4 depicts an installed position where coupler pin 42 engages the front side of aperture 23. When a draft load is applied on coupler 14 through pin 42, the first stack 17 of elastomeric elements is compressed between vertical wall 21 and coupler follower 22 which abuts stops 11. The first or "draft" stack 17 is compressed when the coupler is subjected to buff loads and also when the coupler is subjected to draft loads. To install the elastomeric units 25 in the front portion of the cushioning unit, the coupler follower 22 may be held in place with a predetermined pressure on the elastomeric pads 27, using a set of destructible shear pins fixing the coupler follower to the yoke. In the rear stack, two c-shaped spacers (not shown) may be provided on rear unit 30 between rear plate 32 and nut 54 to provide a pre-load on the rear stack for installation.

Referring again to FIG. 2, each elastomeric unit 25 comprises elastomeric pad 27 mounted in a recessed area 29 of the metal plate 225. The rigid plates may be adapted to prevent over-compression of the elastomeric pads 27. For example, the plates may be made of cast or fabricated metal such as steel, and a stop surface may be provided on the periphery of the plate around the recess. Additionally, protrusions 28 permit a nesting arrangement of elastomeric units 25 in stack 17, as shown in FIG. 4 and FIG. 5, which also contributes to alignment of the elastomeric units 25. Metal-to-metal contact on the stop surfaces occurs when an elastomeric pad 27 between two adjacent plates 225 is compressed a predetermined amount, such as 20-80%, and in embodiments 20-60%, of the uncompressed thickness of the pads. In embodiments, the pads in the front or draft stack compress about 0.5 inches (from their uncompressed thickness prior to installation) before metal to metal contact prevents further compression. The plates 225 forming front stack 17 extend to the walls and/or the straps of the yoke 206. By way of example and not limitation, an uncompressed thickness of each pad 27 forming front stack 17 may be about 1.37 inches. Installed, under a static load of 32 klb, the thickness of the draft pads is 0.92. Fully compressed, at the point when metal-on-metal contact of the plates prevents further compression of the pads, the elastomeric pads 37 in the draft stack may have a thickness of 0.68 inches. These dimensions are provided for guidance and should not be deemed to limit the invention. In practice many configurations are possible without departing from the scope of the invention.

The elastomeric pads 27 may be provided with a through hole in the center, which aligns with a protrusion, which may be cast, stamped or fabricated on the plate, for example, and provided to keep the pads in alignment. The diameter of the through hole may be referred to as the "inner diameter". The lateral edge of each elastomeric pad 27 may be curved in a toroidal manner, and the outside diameter of the pad is measured at the middle of the thickness dimension of the pad.

FIG. 3 represents the rear "buff" portion 30 of the cushioning apparatus, positioned adjacent to and rearward of the yoke and comprising front plate 31 connected to rear plate 32 by a rod 34 which passes through a plurality of elastomeric units 35. Although a single center rod 34 is shown, a plurality of rods may also be used. Each elastomeric unit 35 comprises a plate 226 and at least one elastomeric pad 37, similar in construction to the elastomeric unit 25. However, the plate 226 and the elastomeric pad 37 both have a hole to receive rod 34. As in the description of FIG. 2, only a single elastomeric unit 35 is shown in FIG. 3, whereas 10-20 plates 226 and a corresponding number of elastomeric pads could be employed, depending on the design. The elastomeric unit(s) 35 substantially fill the sill area to help align elastomeric units 35 and pads 37. Pads 37 may be shaped like pads 27. In the embodiment shown, each elastomeric pad 37 may be circular when viewed in plan, having an outer diameter. An "inner diameter" defines a through hole in the middle adapted to receive the center rod.

Pads 37 in the buff stack 16 may have the same general shape as pads 27 in the draft stack 17 but they are scaled larger. The maximum design force of the larger pads 37 is higher due to larger surface area, but the surface pressure on each pad is the same. For example, and not by way of limitation, the uncompressed thickness of a pad 37 may be about 1.70 inches and the outer diameter may be about 8.82. Compressed for installation with a force of about 32 klb, the installed thickness of the pads is about 1.24 inches. Under full compression, with metal-to-metal contact of plates 226 preventing further compression of pads 37, the pad thickness may be about 0.91 inches and the outside diameter may reach 10.63 inches. Thus, in embodiments, the pads and plates are designed to allow compression of 20-80 percent, and in embodiments 40-60 percent, where the amount that the pad is compressed at full compression is expressed as a percentage of the uncompressed thickness of the pad, prior to installation. Bolt head 33 is flush mounted in front plate 31 so that the rear unit 30 may be mounted directly against front unit 20. In embodiments, rear unit 30 is not attached to the front unit 20, which facilitates installation. As shown in FIG. 5, rod 34 is secured by nut 54.

The same elastomeric material may be used for the elastomeric pads in the draft stack as in the buff stack, such as a thermoplastic elastomer.

The elastomeric units of the draft pack are adapted to slide between straps 26 of yoke 20. In an E-type arrangement, the yoke is attached to the coupler using a draft key, but the performance considerations for the pads and plates are similar.

In embodiments, draft stack 17 is provided in a pre-shortened installation configuration, which allows draft portion 20 and the buff portion 30 to slide into the pocket and allows the coupler to be installed without interference. A plurality of shear pins, for example four shear pins pass through the yoke into the coupler follower 22. The pins break on first impact, and in this fully-installed or post-installation position, the coupler is pre-stressed, applying buff force against the first and second stacks.

Figure 6:
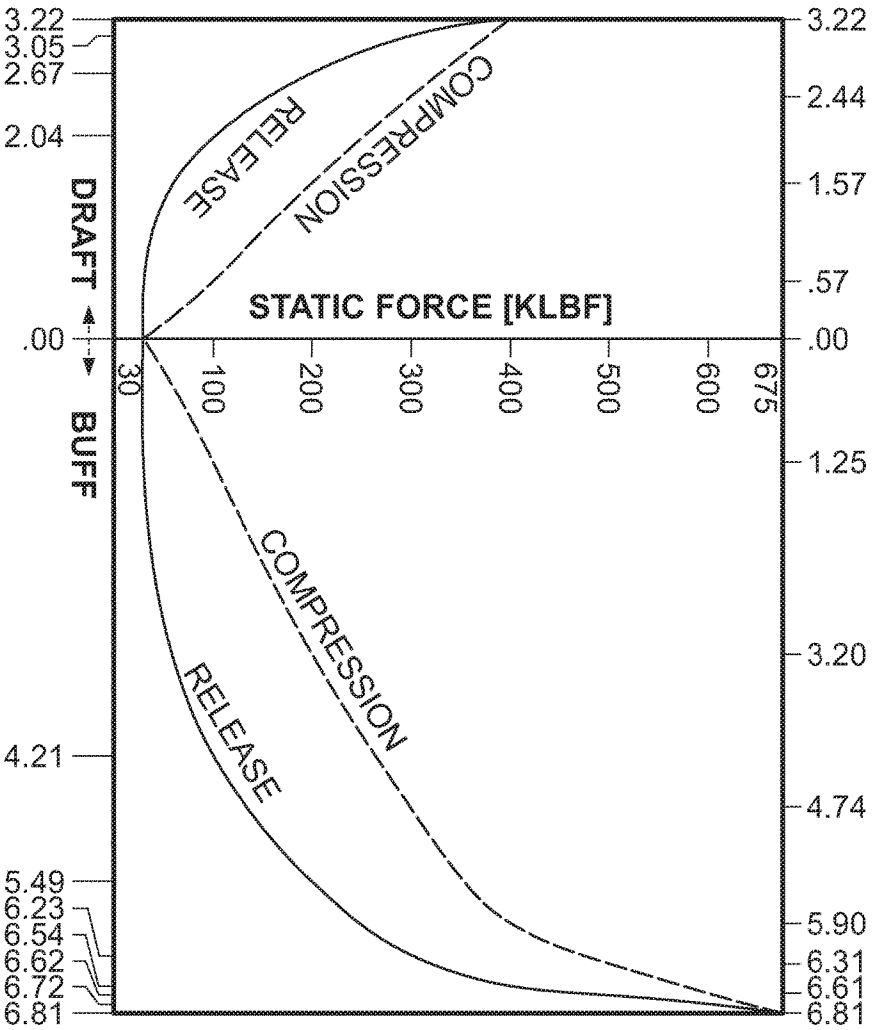
FIG. 6 depicts the response of a cushioning unit to static buff and draft loads.

FIG. 6 depicts performance modeling of a cushioning unit according to the invention using response to static buff and draft loads. The dynamic response of the material would be dependent on impact speed and could approach twice the static load values. Nevertheless, the response to static loads provides information to guide product design to achieve performance objectives. In this example, 11 pads are used in the buff stack, each having an uncompressed thickness of 1.7 inches and an uncompressed diameter of 8.82 inches. The draft stack comprises 14 pads, each having an uncompressed thickness of 1.37 inches and uncompressed diameter of 6.63 inches. A static compression test is performed to obtain the response to static load and subsequent recovery or "release". Separation of compression and release curves represents hysteresis. The relatively large hysteresis depicted in the response curves is at least partly an advantage of using the plates to limit compression of the elastomeric pads within a predetermined range, resulting in a greater absorption and dissipation of impact energy. At the same time, very little permanent deformation is expected during the lifetime of the cushioning unit, on the order of less than 10%, preferably less than 5%. The stiffening observed under buff loads greater than about 400 klb occurs after the draft stack is fully compressed, and the rear "buff" stack assumes the remainder of the force absorption. Hysteresis may be expressed as the ratio of energy absorbed by cushioning unit ($W_A$) to the energy input during impact ($W_E$) (modeled as a static load). Hysteresis for the cushioning unit may be extrapolated from the deflection of the buff and draft pads versus applied static force during compression and release from different starting points (i.e., pre-loaded, uncompressed and fully compressed). In embodiments a cushioning unit according to the invention will have a $W_A/W_E$ ratio derived in this manner of 0.3 to 0.65. The large distance between the compression and release curves in FIG. 6 indicates relatively high hysteresis for a cushioning unit according to the invention.

The description of the foregoing preferred embodiments is not to be considered as limiting the invention, which is defined according to the appended claims. The person of ordinary skill in the art, relying on the foregoing disclosure, may practice variants of the embodiments described without departing from the scope of the invention claimed. A feature or dependent claim limitation described in connection with one embodiment or independent claim may be adapted for use with another embodiment or independent claim, without departing from the scope of the invention.

What is claimed is:

1. An end-of-car cushioning device for a railway car, comprising:

a yoke having aligned apertures at a front end adapted to receive a pin or key for attaching the yoke to a railway car coupler, and having a vertical wall at a second end of the yoke opposite the front end;

a coupler-receiving member adapted to receive buff force from the coupler and adapted to move inside the yoke;

a first stack of elastomeric units positioned between the coupler-receiving member and the vertical wall of the yoke, each elastomeric unit in the first stack comprising a metal plate and at least one elastomeric pad, said first stack being compressed by draft and buff loads on the coupler;

a front buff plate positioned adjacent to and rearward of the yoke and connected to a rear buff plate by a rod;

a second stack of elastomeric units positioned between the front buff plate and the rear buff plate, each elastomeric unit in the second stack comprising a metal plate and at least one elastomeric pad, said second stack being compressed in response to buff loads on the coupler; wherein, the yoke, the front buff plate and the rear buff plate are positioned within a center sill of the railway car.

2. The end of car cushioning device according to claim 1, wherein the yoke is not mechanically attached to the front buff plate or the rear buff plate.

3. The end-of-car cushioning device according to claim 1, wherein, each elastomeric unit in the first stack comprises a metal plate having a vertically oriented face and an elastomeric member in a middle portion of the vertically oriented face; wherein at least one of said plates comprises an edge portion extending around the elastomeric member, said edge portion having a front surface feature that cooperates with a rear surface in an edge portion of an adjacent plate; and wherein at full compression of the first stack, contact between the front surface feature and the rear surface of an adjacent plat prevents compression of an elastomeric member between them beyond a predetermined thickness.

4. The end-of-car cushioning device according to claim 3, wherein, each elastomeric unit in the second stack comprises a plate having a vertically oriented face and an elastomeric member in a middle portion of the vertically oriented face; wherein each plate in said second stack comprises an edge portion extending around the elastomeric member, said edge portion having a front surface feature that cooperates with a rear surface feature in an edge portion of an adjacent plate; wherein at full compression of the second stack, contact between the front surface feature and the rear surface feature of adjacent plates prevents compression of an elastomeric member between them beyond a predetermined thickness.

5. The end of car cushioning device according to claim 4, wherein all of the elastomeric units in the first stack have a raised feature that mates with a recessed feature in an adjacent plate so that all of the elastomeric units in the first stack are nested.

6. The end of car cushioning device according to claim 5, wherein all of the elastomeric units in the first and second stack have a raised feature that mates with a recessed feature in an adjacent plate, so that all of the elastomeric units in the first and second stack are nested.

7. The end of car cushioning unit according to claim 1, wherein the front buff plate, the rear buff plate and the second stack of elastomeric units all have about the same approximately rectangular plan dimension which substantially corresponds to a rectangular cross-sectional dimension of the railway car sill; wherein one end of the rod is received in a recess in the front buff plate forming a flush front surface on the front buff plate; wherein the rod is received through aligned apertures in each of the elastomeric units; and wherein the rod, the front buff plate, the rear buff plate and the second stack of elastomeric units form an assembly positioned in the sill rearward of the yoke and separated from the yoke.

8. The end of car cushioning unit according to claim 6, wherein the sill has AAR Standard EOC-8, EOC-9 or EOC-10 dimensions.

9. The end of car cushioning unit according to claim 6, wherein the aligned apertures of the yoke are adapted to receive a pin.

10. The end of car cushioning unit according to claim 9, wherein the yoke is an F-Type.

11. The end of car cushioning unit according to claim 6, wherein the aligned apertures of the yoke are adapted to receive a draft key.

12. The end of car cushioning unit according to claim 11, wherein the yoke is an E-Type.

13. The end of car cushioning unit according to claim 1, wherein the metal plates each has a face that substantially fills an interior cross-section of the sill.

* * * * *